US010376905B2

(12) United States Patent
Yang

(10) Patent No.: US 10,376,905 B2
(45) Date of Patent: Aug. 13, 2019

(54) FOLDABLE SHOWER HEAD

(71) Applicant: Purity (Xiamen) Sanitary Ware Co., Ltd., Xiamen, Fujian (CN)

(72) Inventor: Xiwen Yang, Xiamen (CN)

(73) Assignee: PURITY (XIAMEN) SANITARY WARE CO., LTD., Xiamen, Fujian (CN)

( * ) Notice: Subject to any disclaimer, the term of this patent is extended or adjusted under 35 U.S.C. 154(b) by 11 days.

(21) Appl. No.: 15/871,097

(22) Filed: Jan. 15, 2018

(65) Prior Publication Data

US 2019/0217313 A1 Jul. 18, 2019

(51) Int. Cl.
*B05B 1/18* (2006.01)
*B05B 1/16* (2006.01)

(52) U.S. Cl.
CPC ..... *B05B 1/185* (2013.01); *B05B 1/16* (2013.01)

(58) Field of Classification Search
CPC .... B05B 1/12; B05B 1/16; B05B 1/18; B05B 1/185
See application file for complete search history.

(56) References Cited

U.S. PATENT DOCUMENTS 4,975,993 A * 12/1990 Black ..... B05B 15/652 4/601
6,775,865 B1 * 8/2004 Lin ..... B05B 1/18 4/615
2005/0086737 A1 * 4/2005 Leung ..... B05B 1/18 4/601
2012/0312901 A1 * 12/2012 Hu ..... B05B 1/18 239/548

* cited by examiner

*Primary Examiner* — Darren W Gorman
(74) *Attorney, Agent, or Firm* — Leong C. Lei

(57) ABSTRACT

A foldable shower head includes a housing, a water valve, and a plurality of water outlet covers. The housing is formed with a diversion passage therein. The water valve is formed with a water outlet passage therein. The water outlet passage is communicated with the diversion passage. The water outlet covers each have a water inlet end pivotally connected to the housing and a water outlet end. The water inlet end of each water outlet cover is provided with a water inlet. The water outlet end of each water outlet cover is provided with a water outlet. The water inlet end of each water outlet cover is linked and connected with the water valve. By folding and unfolding the water outlet covers, the shower head provides different spray modes.

9 Claims, 20 Drawing Sheets

B

FOLDABLE SHOWER HEAD

BACKGROUND OF THE INVENTION

1. Field of the Invention

The present invention relates to a shower head, and more particularly to a foldable shower head.

2. Description of the Prior Art

As shown in FIG. 1 and FIG. 2, a conventional shower head comprises a spherical head 10, a socket 20, a gasket 30, a main body 40, a fixing ring 50, a water sealing seat 60, and a cover 70. The socket 20 is fixed to the gasket 30. The water flows through the spherical head 10 to the sealing seat 60. The sealing seat 60 and the cover 70 are connected together by using a welding machine to form a water chamber therebetween. After the water enters the sealing seat 60, the water will flow out from the cover 70. This structure cannot change the spray angle and the water outlet function by adjusting the cover 70, that is, the spray mode cannot be adjusted and is inconvenient.

Chinese Patent No. 2010105548382.3 discloses a foldable hand-held showerhead which comprises a main body, a sealing cover, a flip cover and a face cover. The flip cover is hinged to the main body and can be turned. The water is switched on and off by turning the flip cover. The spray mode of this shower head adopts the face cover to cooperate with the flip cover. This showerhead has only one spray mode.

Accordingly, the inventor of the present invention has devoted himself based on his many years of practical experiences to solve these problems.

SUMMARY OF THE INVENTION

The primary object of the present invention is to provide a foldable shower head that can be switched between two spray modes by unfolding and folding. The spray modes can be adjusted as required.

In order to achieve the aforesaid object, the foldable shower head of the present invention comprises a housing, a water valve, and a plurality of water outlet covers. The housing is formed with a diversion passage therein. The water valve is disposed on the diversion passage. The water valve is formed with a water outlet passage therein. The water outlet passage is communicated with the diversion passage. The water outlet covers each have a water inlet end pivotally connected to the housing and a water outlet end. The water inlet end of each water outlet cover is provided with a water inlet. The water outlet end of each water outlet cover is provided with a water outlet. The water inlet end of each water outlet cover is linked and connected with the water valve. Each water outlet cover can be pivoted about a pivot on a vertical tangent plane to be unfolded and folded relative to the housing. When the water outlet covers are unfolded, the water valve is driven by the water outlet covers to connect the water inlet with the water outlet passage. When the water outlet covers are folded, the water valve is driven by the water outlet covers to disconnect the water inlet from the water outlet passage.

Preferably, a diversion seat is provided in the housing. The diversion passage is formed in the diversion seat. The water valve includes a water valve core and an inner connector. An upper end of the inner connector is movably fitted in the diversion passage of the diversion seat. The water outlet passage is formed in the water valve core. A lower end of the inner connector is fixed in the water outlet passage of the water valve core. The water outlet passage is communicated with the diversion passage through the inner connector. A side of the water valve core is formed with a water hole. A protruding seat is provided in the water outlet passage. A gap is formed between the inner connector and the protruding seat. The gap is in communication with the water hole. The water inlet end of each water outlet cover is pivotally connected to the diversion seat in the housing. The water inlet end of each water outlet cover is linked and connected with the side of the water valve core. When the water outlet covers are pivoted about the pivot to be unfolded, the water valve core and the inner connector are driven to move down so that the water hole of the side of the water valve core is communicated with the water inlet of each water outlet cover. When the water outlet covers are pivoted about the pivot to be folded, the water valve core and the inner connector are driven to move up so that the water hole of the side of the water valve core is offset from the water inlet of each water outlet cover.

Preferably, a plurality of racks are vertically formed on an outer periphery of the water valve core. The water inlet ends of the water outlet covers are provided with gears corresponding to the racks of the water valve core. The water outer covers are linked and connected with the water valve core through meshing of the gears and the racks.

Preferably, the number of the water outlet covers is four. The four water outlet covers are equally spaced and pivotally connected to a lower end of the diversion seat. The water inlet end of each water outlet cover is provided with two gears. The outer periphery of the water valve core has four faces each formed with two corresponding racks.

Preferably, a sealing gasket is provided between the water inlet end of each water outlet cover and the water valve core. The sealing gasket is formed with a drain hole. The water hole is communicated with the water inlet of each water outlet cover through the drain hole. O-shaped sealing rings are provided between the inner connector and the diversion passage and between the inner connector and the water outlet passage.

Preferably, a lower end of the diversion seat is formed with a plurality of curved mounting plates. The water outlet covers are pivotally connected to the curved mounting plates, respectively. Two sides of each curved mounting plate are formed with pivot holes. One end of each water outlet cover is inserted between adjacent two of the curved mounting plates and pivotally connected between the two curved mounting plates by means of the pivot.

Preferably, the housing includes an upper housing and a lower housing connected to each other. A plurality of openings are formed between the upper housing and the lower housing. The diversion seat is disposed in the upper housing. The water inlet ends of the water outlet covers pass through the openings to be pivotally connected to the diversion seat in the housing.

Preferably, the foldable shower head further comprises a spray device disposed at a bottom of the housing. The spray device is connected to a lower end of the water outlet passage of the water valve core.

Preferably, the foldable shower head further comprises a spherical head. An upper end of the spherical head is connected to a water inlet pipe. A lower end of the spherical head is inserted into an upper end of the housing and connected to the diversion seat. The spherical head is formed with a water inlet passage therein. The water inlet passage is in communication with the diversion passage.

Accordingly, the water outlet covers can be pivoted on a vertical tangent plane by using its pivot relationship with the housing so that it can be unfolded and folded relative to the housing.

Therefore, the present invention has two spray modes when in use. In the first spray mode, the water outlet covers are in a vertical downward state (a folded state). At this time, the water in the diversion passage flows out only from the water outlet passage of the water valve, that is, the water flows out downward.

In the second spray mode, the water outlet covers are pivoted to a horizontal state (an unfolded state) from the vertical downward state. The water valve is controlled to connect the water outlet passage with the water inlet of the water outlet cover. At this time, a portion of the water flows downward along the water outlet passage in the water valve. The other portion of the water flows through the water inlet to the water outlet cover and finally flows out from the water outlet of the water outlet cover.

The beneficial effects of the present invention are described below. Through the cooperation of the water outlet covers and the water valve, the shower head can be folded and unfolded to switch two spray modes, meeting different demands and increasing the spray area. The present invention has the advantages of convenient operation, safety and stability.

DETAILED DESCRIPTION OF THE PREFERRED EMBODIMENTS

Figure 1:
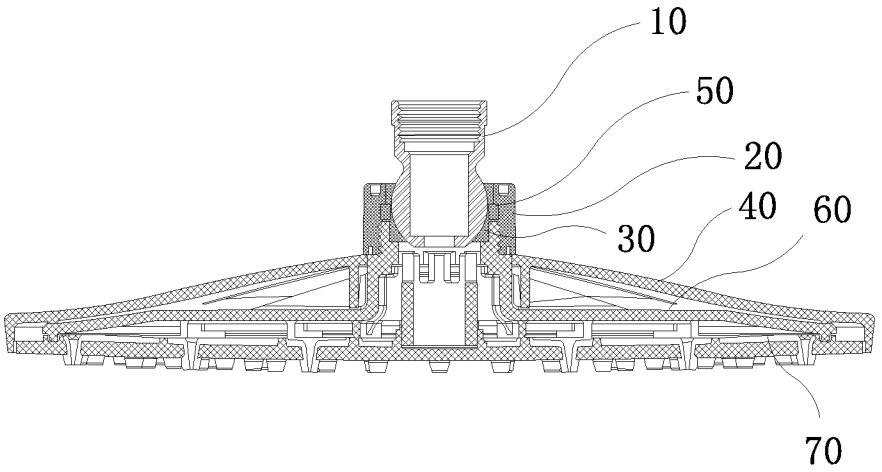
Prior art F I G. 1
FIG. 1 is a cross-sectional view of a conventional shower head.
Figure 2:
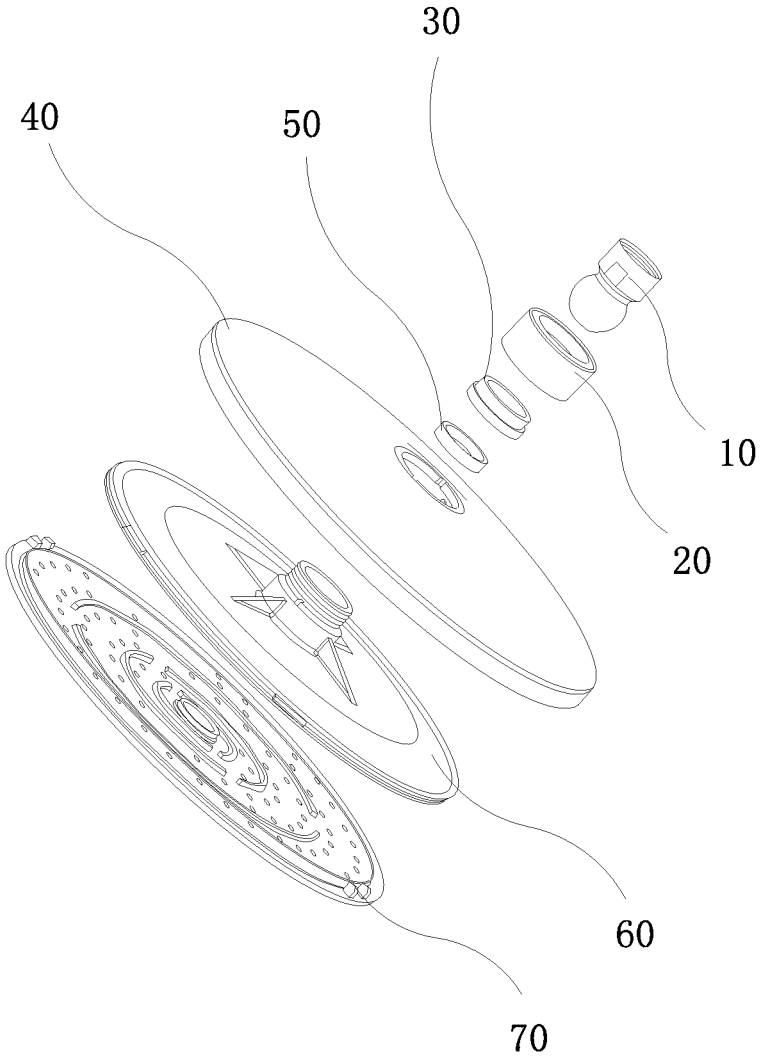
Prior art F I G. 2
FIG. 2 is an exploded view of the conventional shower head.

Embodiments of the present invention will now be described, by way of example only, with reference to the accompanying drawings.

As shown in FIG. 3 to FIG. 20, the present invention discloses a foldable shower head. The foldable shower head comprises a housing 1, a water valve 2, and a plurality of water outlet covers 3. The housing 1 is formed with a diversion passage 41 therein. The water valve 2 is disposed on the diversion passage 41. The water valve 2 is formed with a water outlet passage 211 therein. The water outlet passage 211 is communicated with the diversion passage 41. The water outlet covers 3 each have a water inlet end pivotally connected to the housing 1 and a water outlet end. The water inlet end of each water outlet cover 3 is provided with a water inlet 31. The water outlet end of each water outlet cover 3 is provided with a water outlet 32. The water inlet end of each water outlet cover 3 is linked and connected with the water valve 2. The water outlet cover 3 can be pivoted about a pivot 8 on a vertical tangent plane to be unfolded and folded relative to the housing 1. When the water outlet covers 3 are unfolded, the water valve 2 is driven by the water outlet covers 3 to connect the water inlet 31 with the water outlet passage 211. When the water outlet covers 3 are folded, the water valve 2 is driven by the water outlet covers 3 to disconnect the water inlet 31 from the water outlet passage 211.

Specifically, a diversion seat 4 is provided in the housing 1. The diversion passage 41 is formed in the diversion seat 4. The water valve 2 includes a water valve core 21 and an inner connector 22. An upper end of the inner connector 22 is movably fitted in the diversion passage 41 of the diversion seat 4. The water outlet passage 211 is formed in the water valve core 21. A lower end of the inner connector 22 is fixed in the water outlet passage 211 of the water valve core 21. The water outlet passage 211 is communicated with the diversion passage 41 through the inner connector 22. A side of the water valve core 21 is formed with a water hole 212. A protruding seat 213 is formed in the water outlet passage 211. A gap 214 is formed between the inner connector 22 and the protruding seat 213. The gap 214 is in communication with the water hole 212.

The water inlet end of each water outlet cover 3 is pivotally connected to the diversion seat 4 in the housing 1. The water inlet end of each water outlet cover 3 is also linked and connected with the side of the water valve core 21. When the water outlet covers 3 are pivoted about the pivot 8 to be unfolded, the water valve core 21 and the inner connector 22 are driven to move down so that the water hole 212 of the side of the water valve core 21 is communicated with the water inlet 31 of each water outlet cover 3. When the water outlet covers 3 are pivoted about the pivot 8 to be folded, the water valve core 21 and the inner connector 22 are driven to move up so that the water hole 212 of the side of the water valve core 21 is offset from the water inlet 31 of each water outlet cover 3.

Preferably, a plurality of racks 215 are vertically formed on an outer periphery of the water valve core 21. The water inlet ends of the water outlet covers 3 are provided with gears 33 corresponding to the racks 215 of the water valve core 21. The water outer covers 3 are linked and connected with the water valve core 21 through the meshing of the gears 33 and the racks 215.

Furthermore, the number of the water outlet covers 3 is four. The four water outlet covers 3 are equally spaced and pivotally connected to a lower end of the diversion seat 4. The water inlet end of each water outlet cover 3 is provided with two gears 33. The outer periphery of the water valve core 21 has four faces each formed with two corresponding racks 215.

Figure 20:
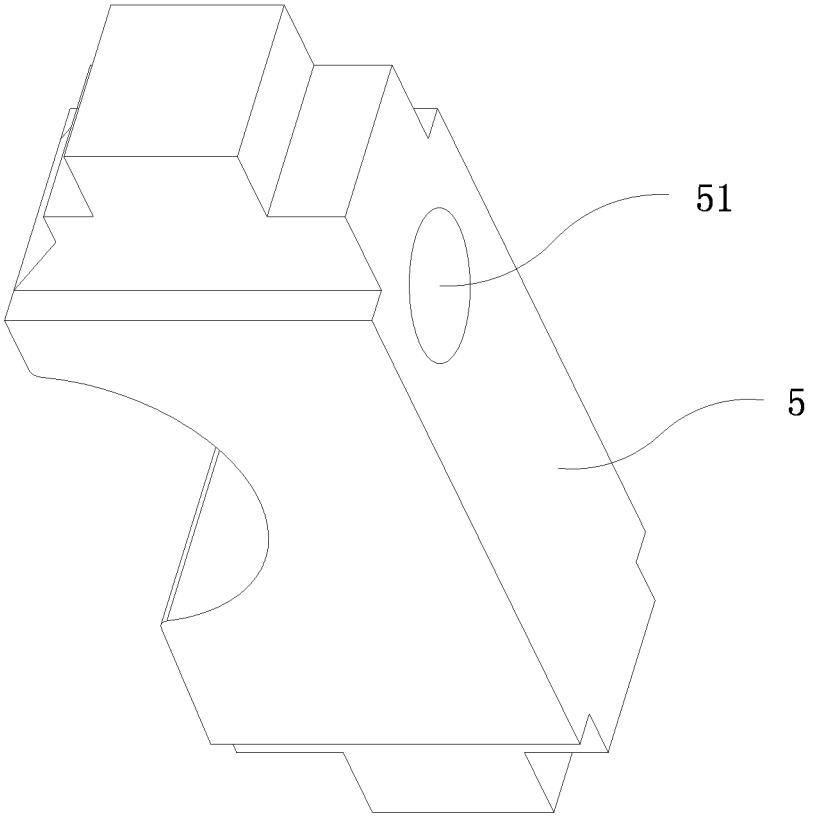
FIG. 20 is a perspective view of the sealing gasket of the present invention.

Furthermore, in order to improve the sealing performance, a sealing gasket 5 is provided between the water inlet end of each water outlet cover 3 and the water valve core 21. As shown in FIG. 20, the sealing gasket 5 is formed with a drain hole 51. The water hole 212 is communicated with the water inlet 31 of each water outlet cover 3 through the drain hole 51. O-shaped sealing rings 9 are provided between the inner connector 22 and the diversion passage 41 and between the inner connector 22 and the water outlet passage 211.

Figure 3:
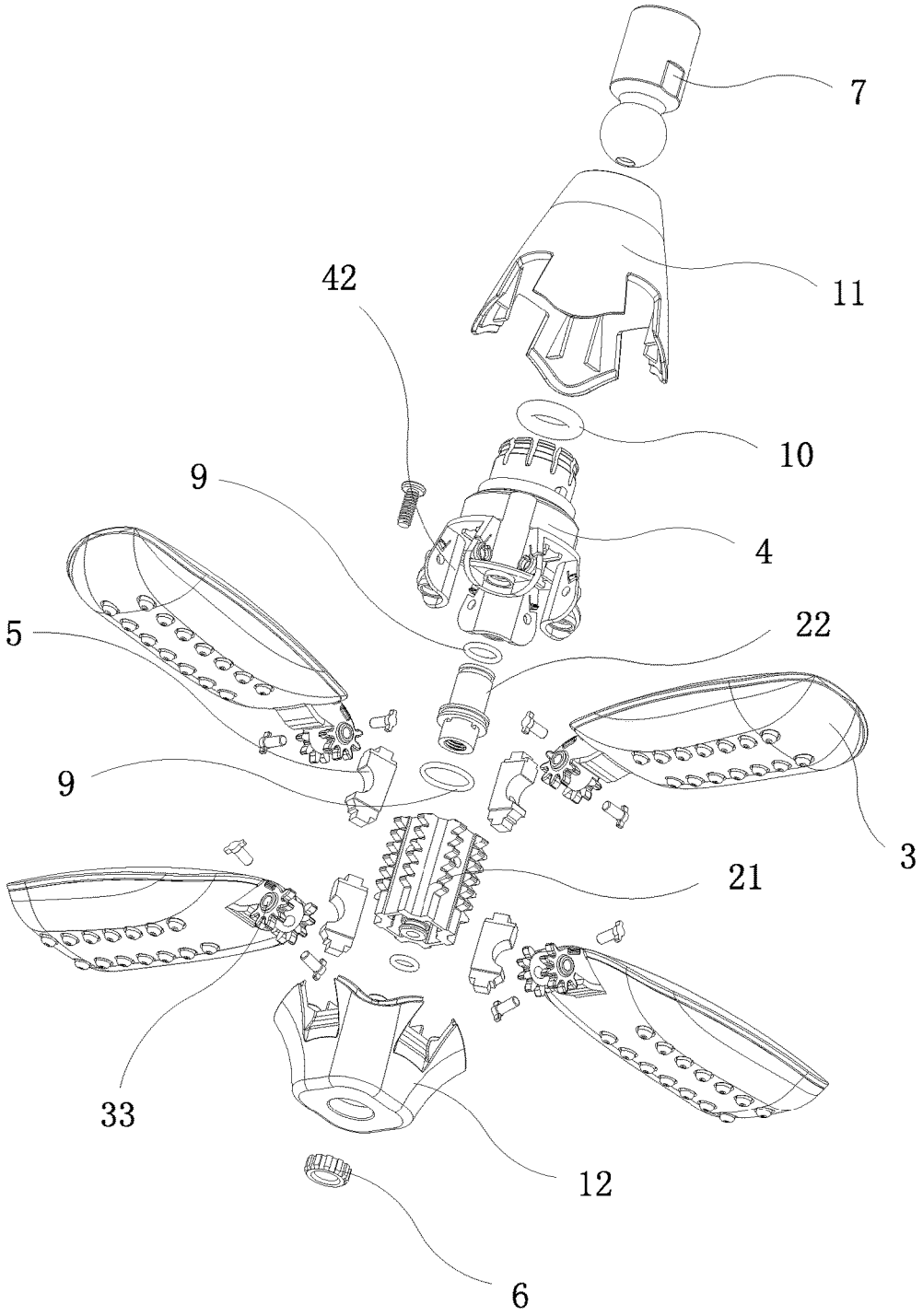
FIG. 3 is an exploded view of the present invention.
Figure 4:
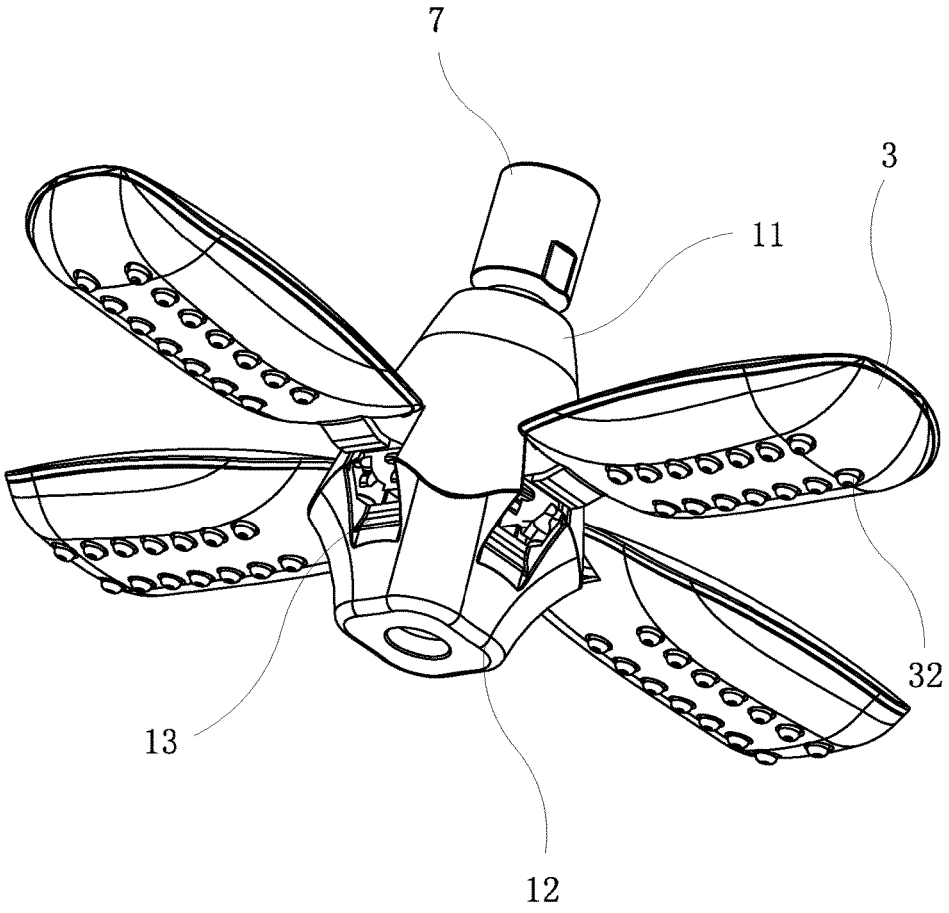
FIG. 4 is a perspective view of the present invention.
Figure 5:
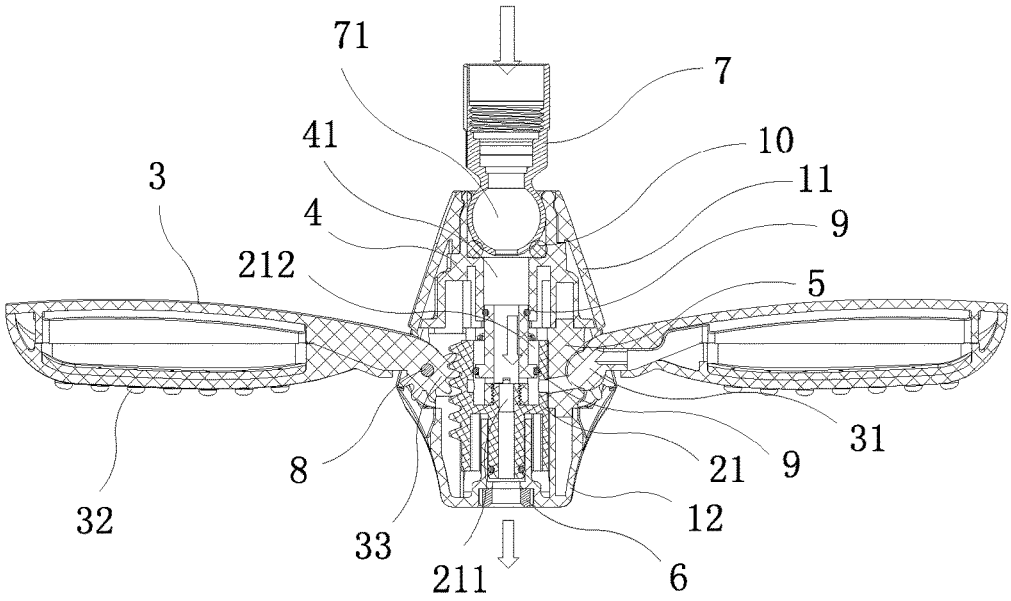
FIG. 5 is a cross-sectional view of the present invention in an unfolded state.
Figure 6:
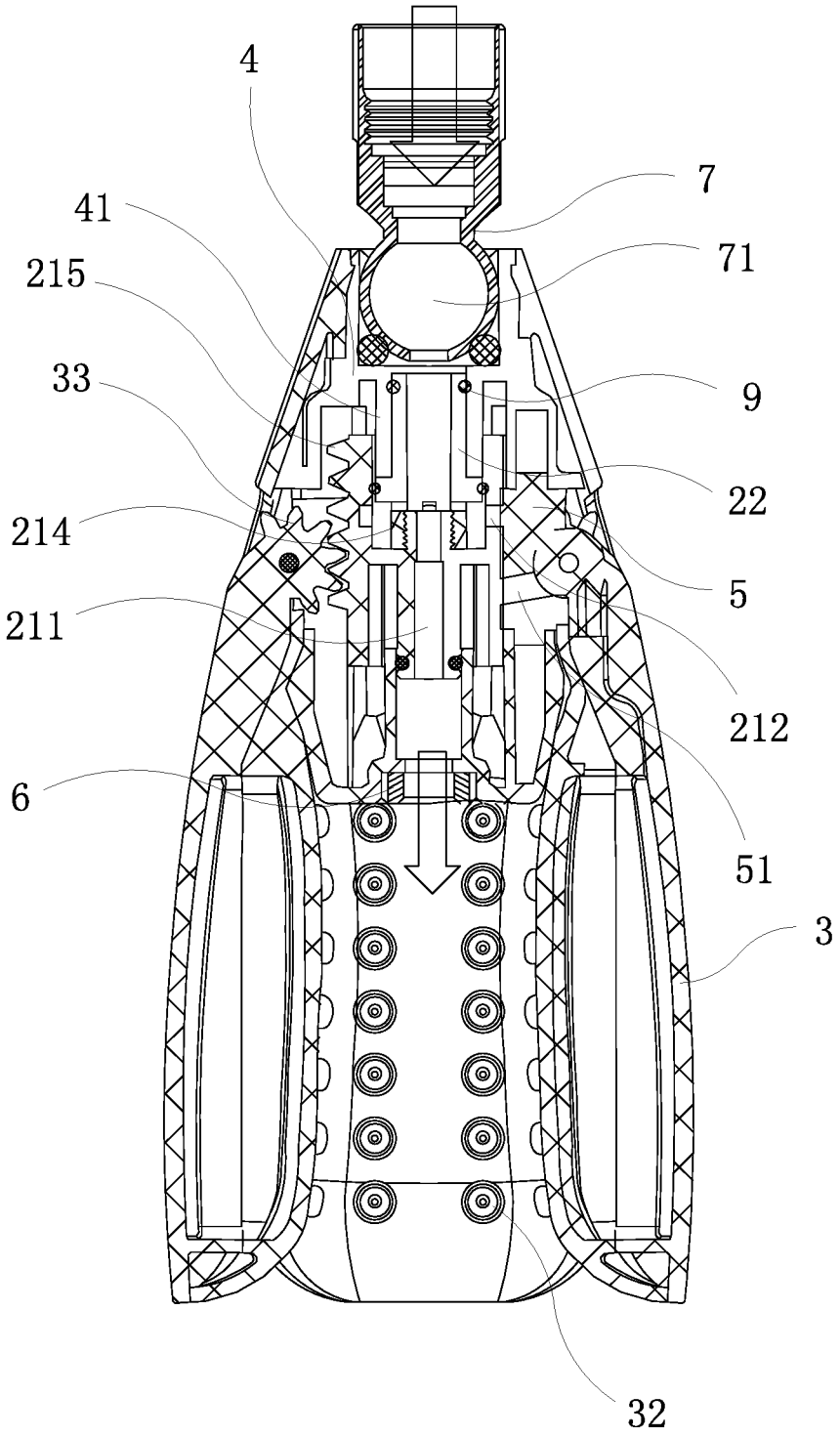
FIG. 6 is a cross-sectional view of the present invention in a folded state.
Figure 7:
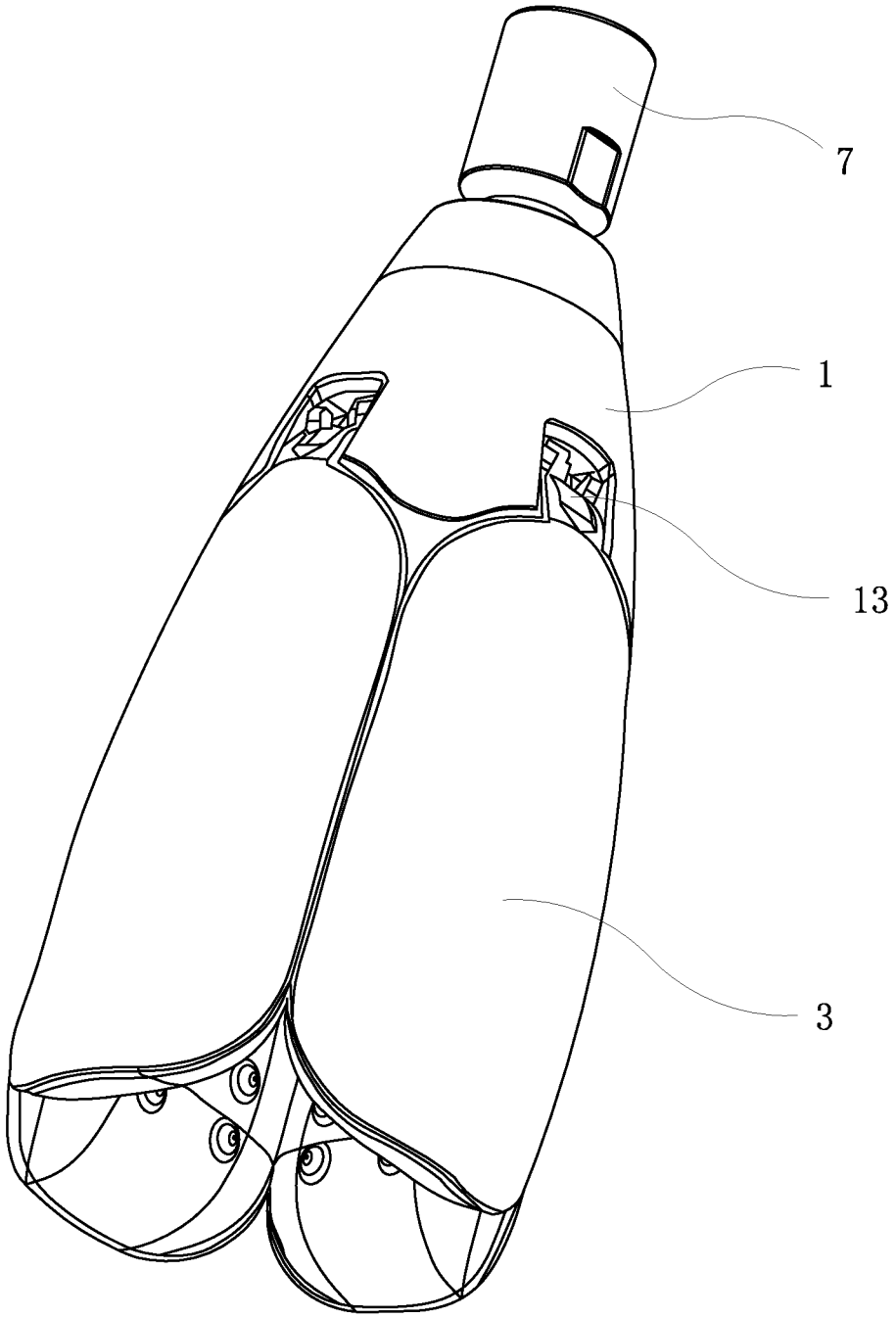
FIG. 7 is a perspective view of the present invention in a folded state.
Figure 8:
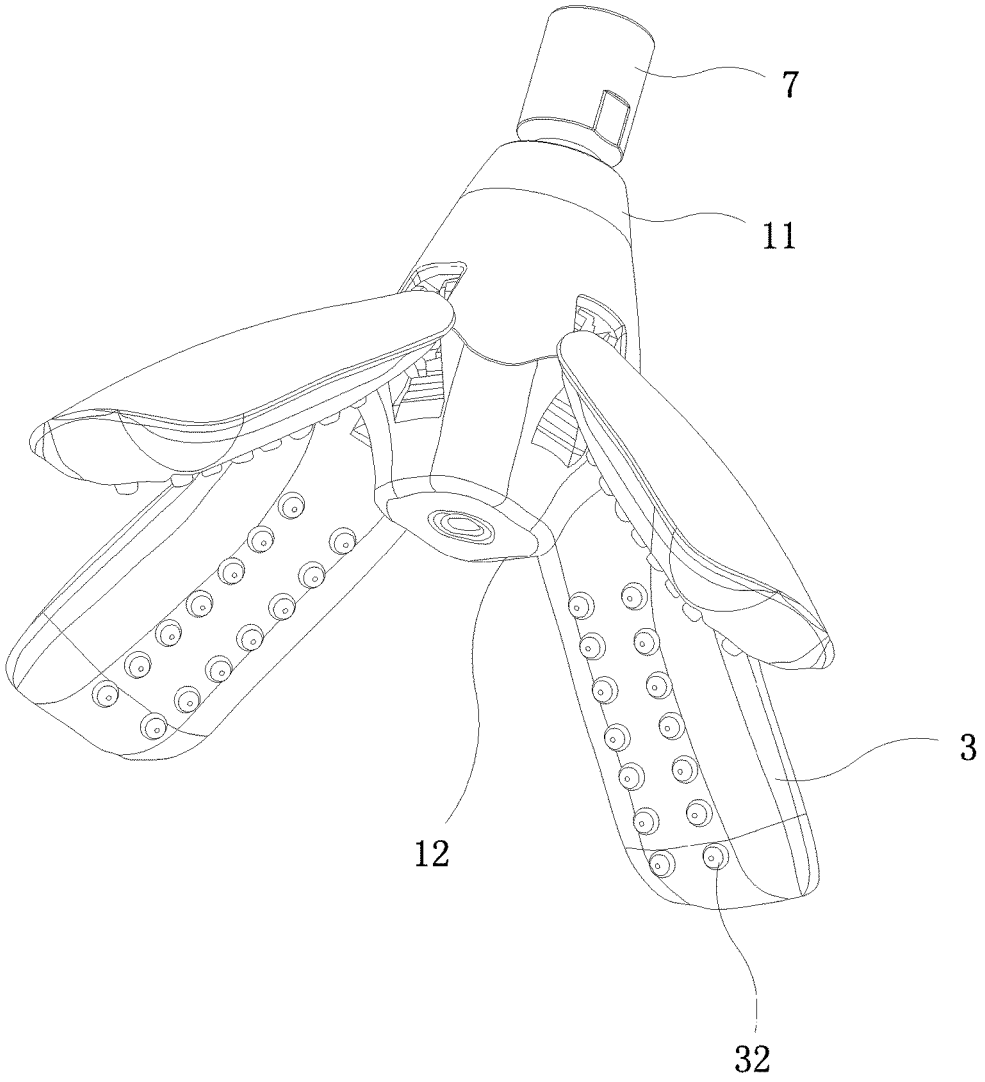
FIG. 8 is a perspective view of the present invention in a semi-unfolded state.
Figure 9:
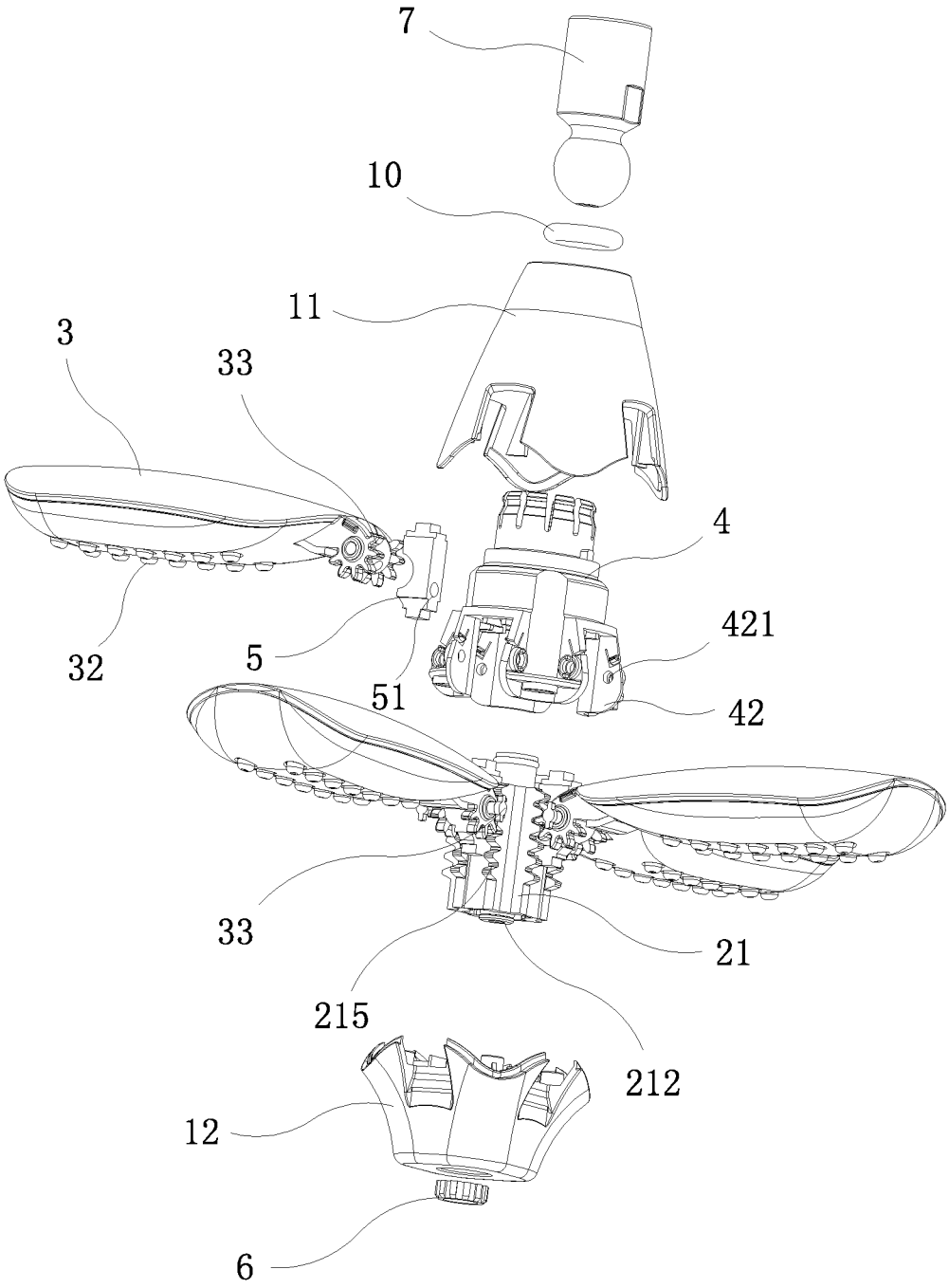
FIG. 9 is a partial exposed view of the water outlet covers of the present invention in an unfolded state.
Figure 10:
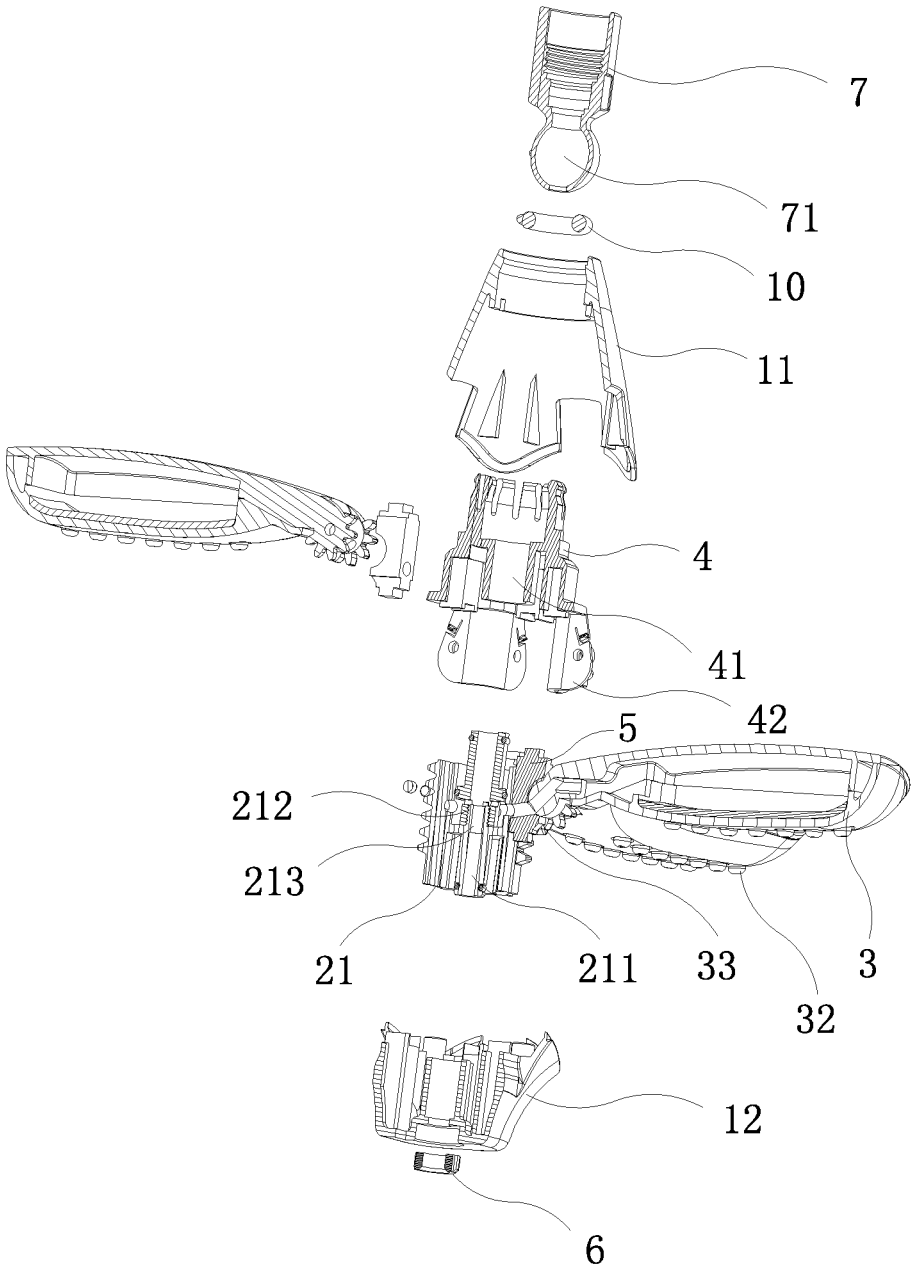
FIG. 10 is a cross-sectional view of FIG. 9.
Figure 11:
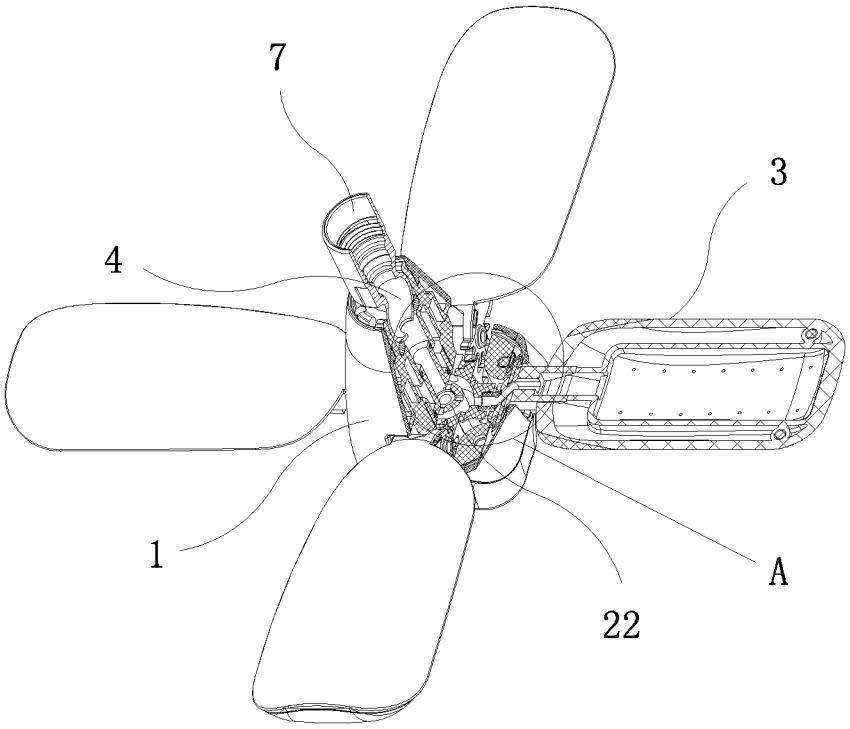
FIG. 11 is a partial sectional view of the present invention.
Figure 12:
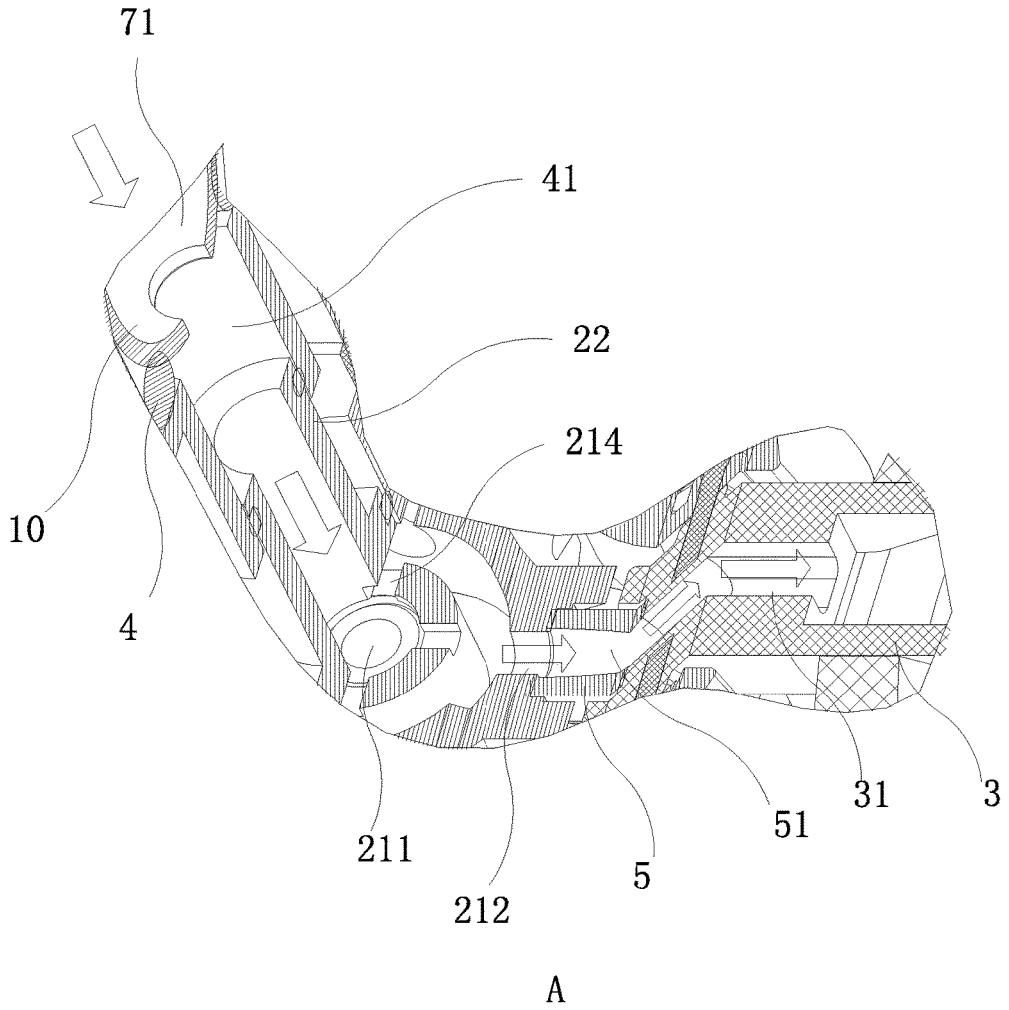
FIG. 12 is an enlarged view of circle A of FIG. 11.
Figure 13:
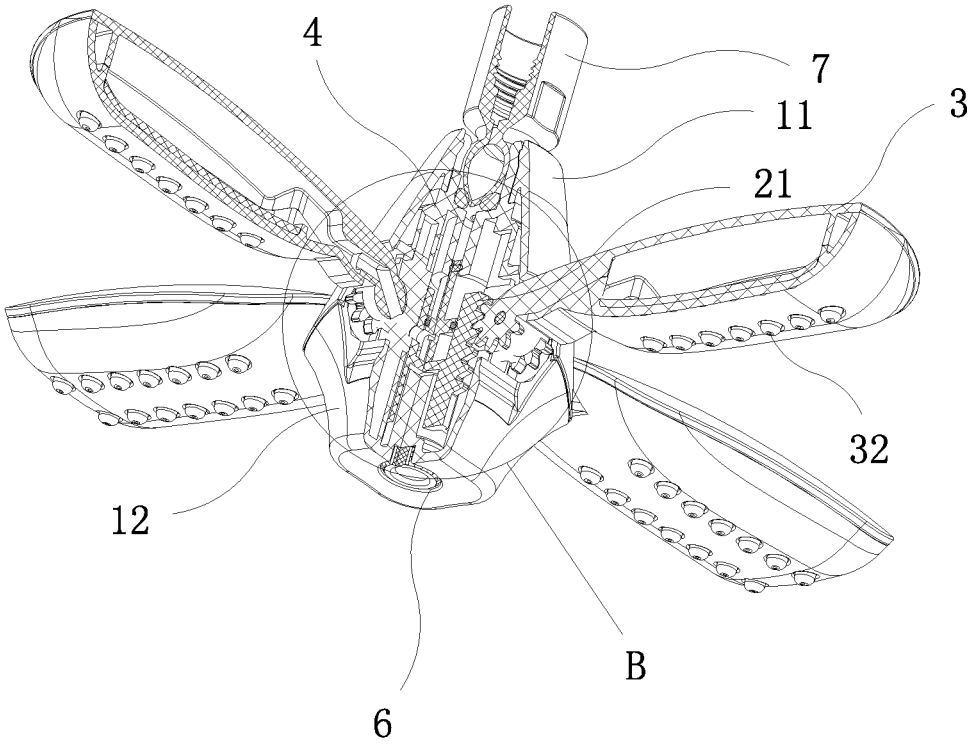
FIG. 13 is a lateral sectional view of the present invention in an unfolded state.
Figure 14:
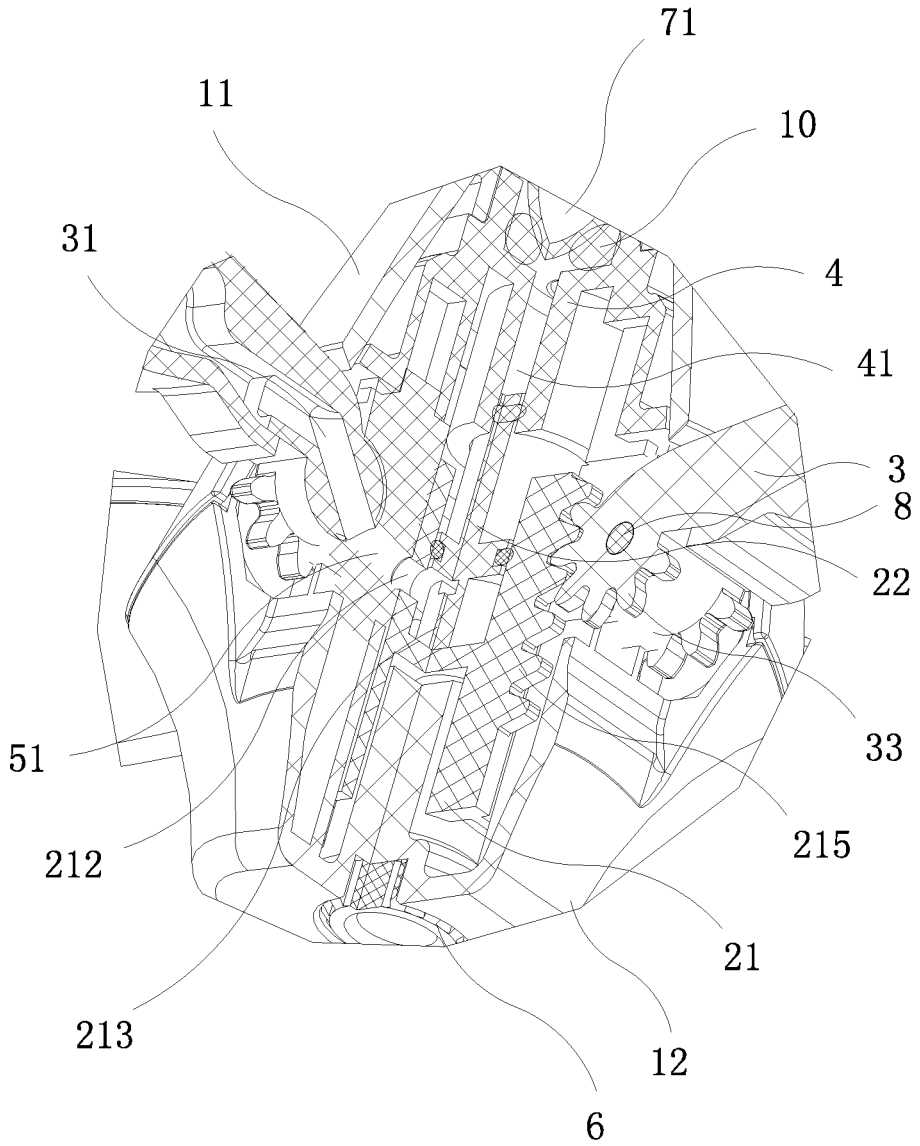
FIG. 14 is an enlarged view of circle B of FIG. 13.
Figure 15:
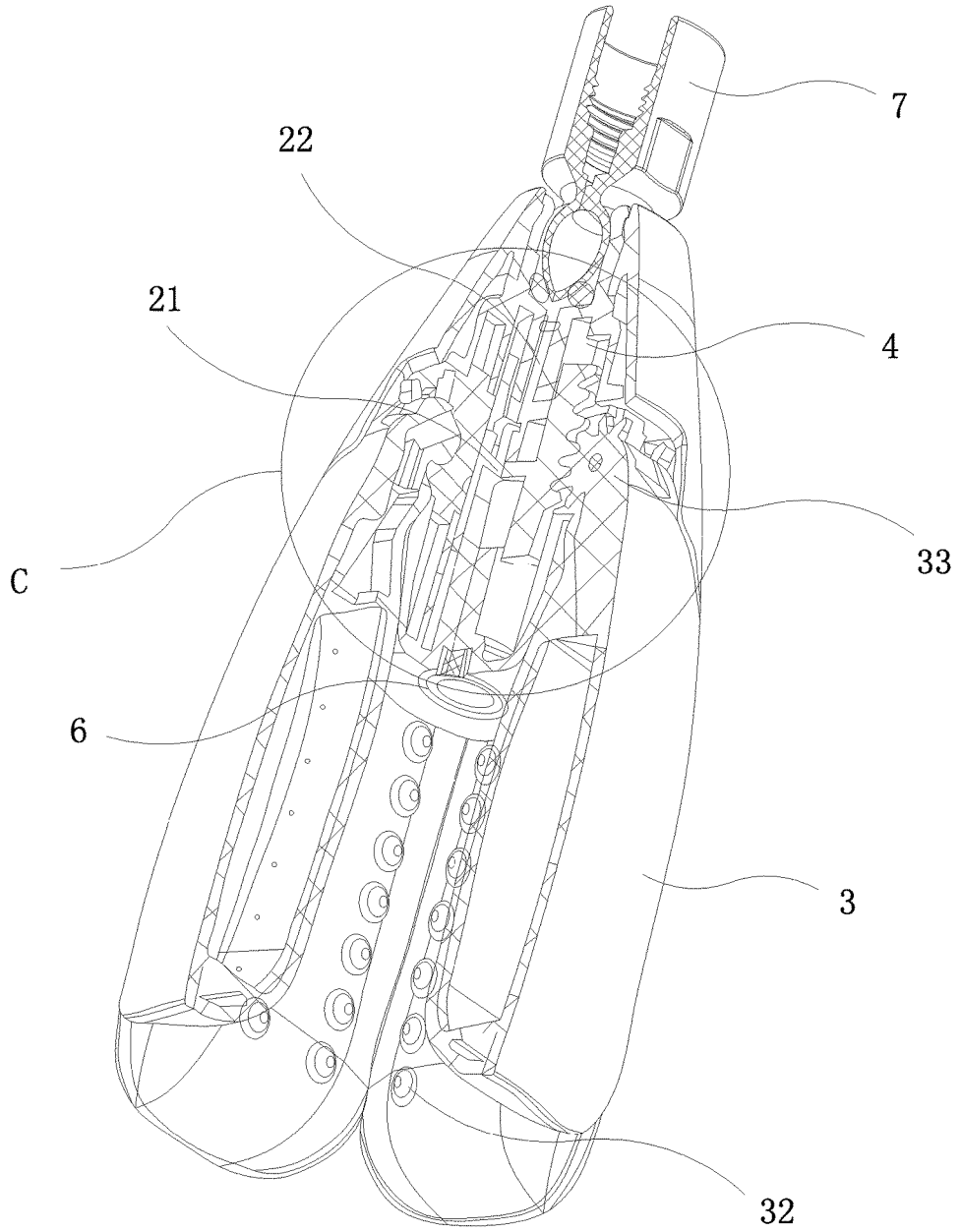
FIG. 15 is a lateral sectional view of the present invention in a folded state.
Figure 16:
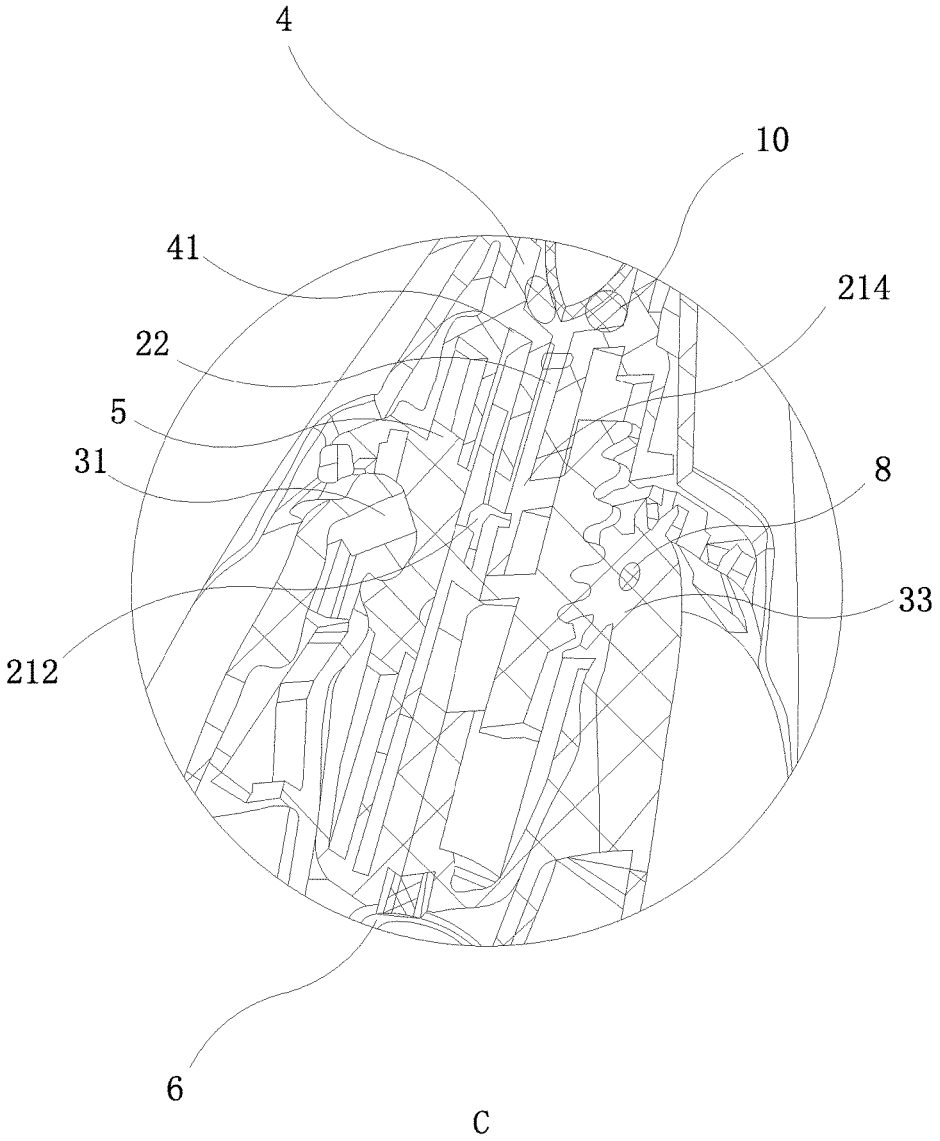
FIG. 16 is an enlarged view of circle C of FIG. 15.
Figure 17:
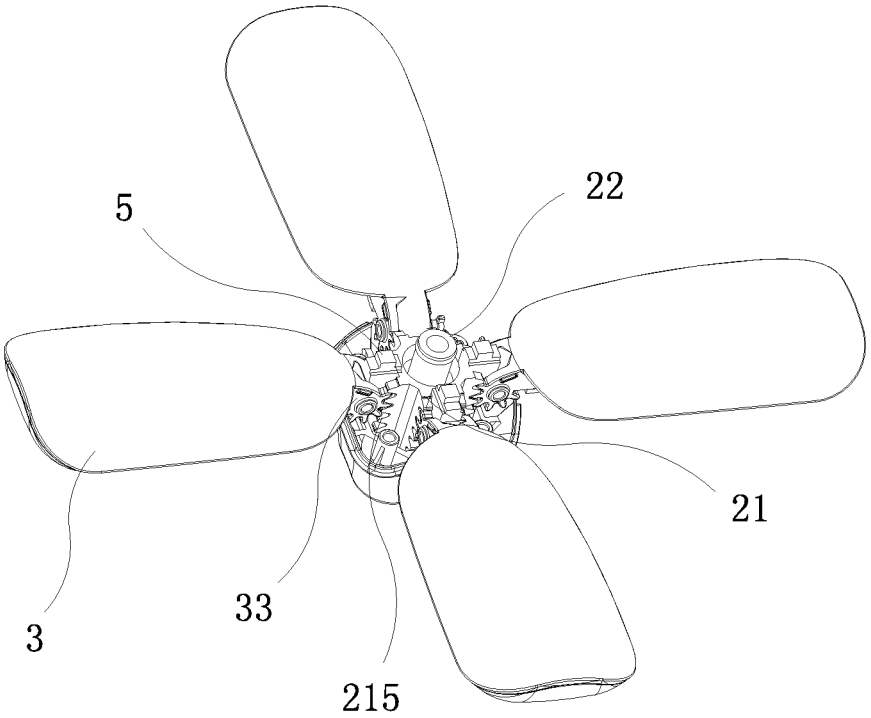
FIG. 17 is a schematic view showing the operation of unfolding the present invention.
Figure 18:
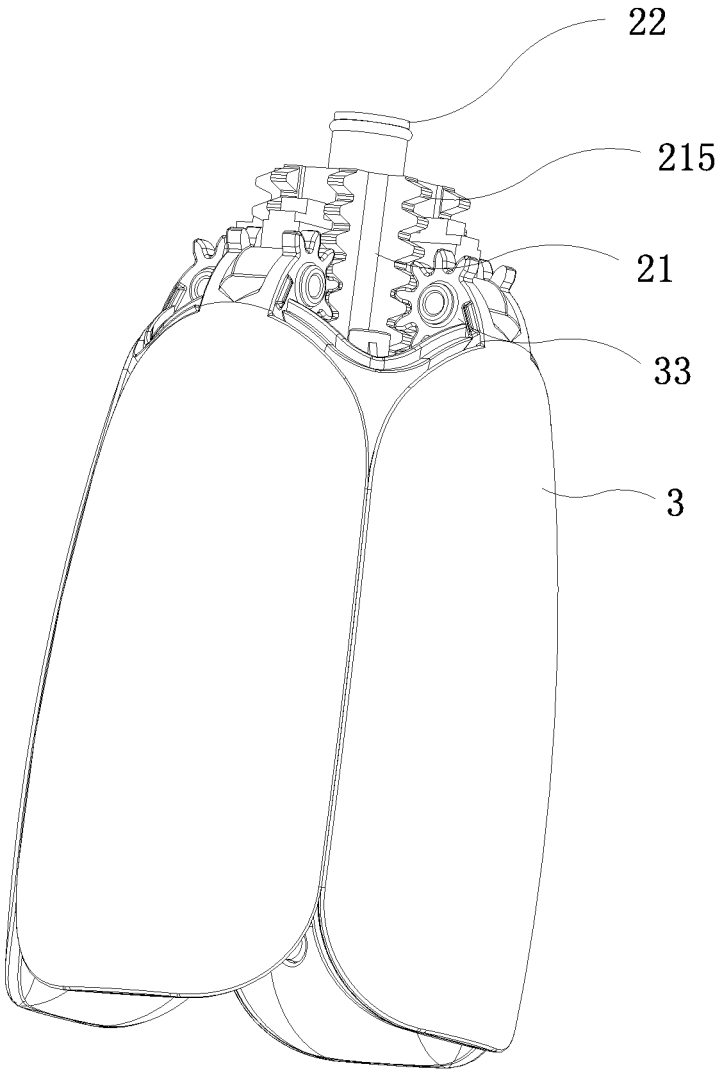
FIG. 18 is a schematic view showing the operation of folding the present invention.
Figure 19:
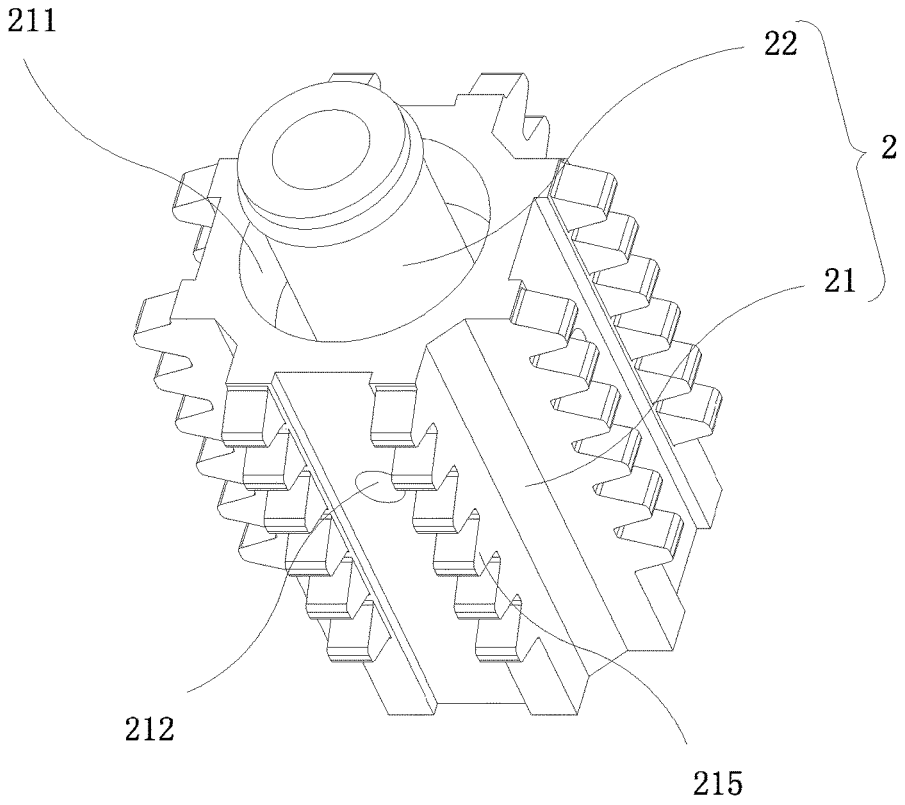
FIG. 19 is a perspective view of the water valve of the present invention.

Furthermore, as shown in FIG. 3 and FIGS. 9-10, the lower end of the diversion seat 4 is formed with a plurality of curved mounting plates 42. The water outlet covers 3 are pivotally connected to the curved mounting plates 42, respectively. Two sides of each curved mounting plate 42 are formed with pivot holes 421. One end of each water outlet cover 3 is inserted between adjacent two of the curved mounting plates 42 and pivotally connected between the two curved mounting plates 42 by means of the pivot.

Furthermore, the housing 1 includes an upper housing 11 and a lower housing 12 connected to each other. A plurality of openings 13 are formed between the upper housing 11 and the lower housing 12. The diversion seat 4 is disposed in the upper housing 11. The water inlet ends of the water outlet covers 3 pass through the openings 13 to be pivotally connected to the diversion seat 4 in the housing 1.

Furthermore, the shower head of this embodiment further includes a spray device 6 disposed at the bottom of the housing 1. The spray device 6 is connected to the lower end of the water outlet passage 211 of the water valve core 21. The spray device 6 is used to disperse and spray the water in the water outlet passage 211.

Furthermore, the shower head further includes a spherical head 7. An upper end of the spherical head 7 is connected to a water inlet pipe. A lower end of the spherical head 7 is inserted into the upper end of the housing 1 and connected to the diversion seat 4. The spherical head 7 is formed with a water inlet passage 71 therein. The water inlet passage 71 is in communication with the diversion passage 41. A sealing ring 10 is provided between the spherical head 7 and the housing 1 to prevent water from flowing out from the gap.

As shown in FIGS. 6-8, 15-16 and 18, when the present invention is used, the present invention may be in an unfolded state or in a folded state. When the water outlet covers 3 are pivoted about the pivot to a vertical downward position, the water outlet covers 3 are in the folded state. The spherical head 7 guides the water from the water inlet pipe (not shown) to the diversion seat 4 in the housing 1. The water flows along the diversion passage 41 of the diversion seat 4 and the inner connector 22 to the water outlet passage 211 of the water valve core 21. At this time, the inner connector 22 and the water valve core 21 are moved up by the water outlet covers 3, so that the water hole 212 is not aligned with the drain hole 51 and the water inlet 31, that is, the water hole 212 and the water inlet 31 are staggered. The water continues to flow downward from the water outlet passage 211. The water flows out from the spray device 6 at the lower end of the water outlet passage 211.

As shown in FIGS. 4-5, 9-11, 13-14 and 17, when the water outlet covers 3 are pivoted from the folded state to the unfolded state, the gears 33 at the water inlet ends of the water outlet covers 3 are moved along the racks 215 to move the water valve core 21 and the inner connector 22 downward. In this process, the inner connector 22 slides downward in the diversion passage 41 until the water outlet covers 3 are fully unfolded. The water hole 212 is aligned and communicated with the drain hole 51 and the water inlet 31. The water flows through the water inlet passage 71, the diversion passage 41 and the inner connector 22 to the gap 214. A portion of the water in the gap 214 continues to flow downward to the water outlet passage 211. The other portion of the water flows transversely to the water hole 212, and then flows through the drain hole 51 of the sealing gasket 5 to the water inlet 31 of the water inlet cover 3, and finally flows out from the water outlet 32.

During the rotation of the water outlet covers 3, the cross section of the water hole 212 communicating with the drain hole 51 and the water inlet 31 gradually increases and the water flowing to the water outlet 32 gradually increases. When the water outlet covers 3 are in a horizontal state (fully unfolded), the water flowing to the water outlet covers 3 is the maximum. At this time, the water flows out through the central water outlet passage and the water outlets of the water outlet covers.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A foldable shower head, comprising a housing, a water valve and a plurality of water outlet covers; the housing being formed with a diversion passage therein; the water valve being disposed in the diversion passage, the water valve being formed with a water outlet passage therein, the water outlet passage being communicated with the diversion passage; the water outlet covers each having a water inlet end pivotally connected to the housing and a water outlet end, the water inlet end of each water outlet cover being provided with a water inlet, the water outlet end of each water outlet cover being provided with a water outlet, the water inlet end of each water outlet cover being linked and connected with the water valve; each water outlet cover being rotatable about a pivot on a vertical tangent plane to be unfolded and folded relative to the housing, wherein when the water outlet covers are unfolded, the water valve is driven by the water outlet covers to connect the water inlet with the water outlet passage; when the water outlet covers are folded, the water valve is driven by the water outlet covers to disconnect the water inlet from the water outlet passage.

2. The foldable shower head as claimed in claim 1, wherein a diversion seat is provided in the housing, the diversion passage is formed in the diversion seat; the water valve includes a water valve core and an inner connector, an upper end of the inner connector is movably fitted in the diversion passage of the diversion seat, the water outlet passage is formed in the water valve core, a lower end of the inner connector is fixed in the water outlet passage of the water valve core, the water outlet passage is communicated with the diversion passage through the inner connector, a side of the water valve core is formed with a water hole, a protruding seat is provided in the water outlet passage, a gap is formed between the inner connector and the protruding seat, the gap is in communication with the water hole; the water inlet end of each water outlet cover is pivotally connected to the diversion seat in the housing, the water inlet end of each water outlet cover is linked and connected with the side of the water valve core; when the water outlet covers are pivoted about the pivot to be unfolded, the water valve core and the inner connector are driven to move down so that the water hole of the side of the water valve core is communicated with the water inlet of each water outlet cover; when the water outlet covers are pivoted about the pivot to be folded, the water valve core and the inner connector are driven to move up so that the water hole of the side of the water valve core is offset from the water inlet of each water outlet cover.

3. The foldable shower head as claimed in claim 2, wherein a plurality of racks are vertically formed on an outer periphery of the water valve core, the water inlet ends of the water outlet covers are provided with gears corresponding to the racks of the water valve core, and the water outlet covers are linked and connected with the water valve core through meshing of the gears and the racks.

4. The foldable shower head as claimed in claim 3, wherein the number of the water outlet covers is four, the four water outlet covers are equally spaced and pivotally connected to a lower end of the diversion seat, the water inlet end of each water outlet cover is provided with two gears, and the outer periphery of the water valve core has four faces each formed with two corresponding racks.

5. The foldable shower head as claimed in claim 2, wherein a sealing gasket is provided between the water inlet end of each water outlet cover and the water valve core, the sealing gasket is formed with a drain hole, the water hole is communicated with the water inlet of each water outlet cover through the drain hole; and O-shaped sealing rings are provided between the inner connector and the diversion passage and between the inner connector and the water outlet passage.

6. The foldable shower head as claimed in claim 2, wherein a lower end of the diversion seat is formed with a plurality of curved mounting plates, the water outlet covers are pivotally connected to the curved mounting plates respectively, two sides of each curved mounting plate are formed with pivot holes, one end of each water outlet cover is inserted between adjacent two of the curved mounting plates and pivotally connected between the two curved mounting plates by means of the pivot.

7. The foldable shower head as claimed in claim 2, wherein the housing includes an upper housing and a lower housing connected to each other, a plurality of openings are formed between the upper housing and the lower housing, the diversion seat is disposed in the upper housing, and the water inlet ends of the water outlet covers pass through the openings to be pivotally connected to the diversion seat in the housing.

8. The foldable shower head as claimed in claim 2, further comprising a spray device disposed at a bottom of the housing, the spray device being connected to a lower end of the water outlet passage of the water valve core.

9. The foldable shower head as claimed in claim 2, further comprising a spherical head, an upper end of the spherical head being connected to a water inlet pipe, a lower end of the spherical head being inserted into an upper end of the housing and connected to the diversion seat, the spherical head being formed with a water inlet passage therein, the water inlet passage being in communication with the diversion passage.

* * * * *